US005234212A

United States Patent [19]

Dutra, Jr.

[11] Patent Number: 5,234,212

[45] Date of Patent: Aug. 10, 1993

[54] DOCUMENT RECEIVING TRAY ASSEMBLY AND METHOD OF USING SUCH

[76] Inventor: Joseph G. Dutra, Jr., 4568 Thornton Ave., Fremont, Calif. 94536-5662

[21] Appl. No.: 908,033

[22] Filed: Jul. 6, 1992

[51] Int. Cl.[5] ..... B65H 31/00

[52] U.S. Cl. ..... 271/207; 271/213

[58] Field of Search ..... 271/207, 213

[56] References Cited

U.S. PATENT DOCUMENTS

| | | | |
|---|---|---|---|
| 2,005,370 | 6/1935 | Hughey . | |
| 3,617,053 | 11/1971 | Menard | 271/207 X |
| 3,912,389 | 10/1975 | Miyamoto . | |
| 4,191,467 | 3/1980 | Schieck . | |
| 4,814,825 | 3/1989 | Johdai et al. . | |
| 4,995,602 | 2/1991 | Nakadai et al. | 271/207 |
| 5,061,098 | 10/1991 | Engelhardt et al. . | |
| 8,226,950 | 1/1992 | Hirayama et al. . | |

FOREIGN PATENT DOCUMENTS

| | | | |
|---|---|---|---|
| 41348 | 2/1988 | Japan | 271/207 |
| 132019 | 5/1990 | Japan | 271/207 |
| 286564 | 11/1990 | Japan | 271/207 |

*Primary Examiner*—Robert P. Olszewski

*Assistant Examiner*—Boris Milef

*Attorney, Agent, or Firm*—Flehr, Hohbach, Test, Albritton & Herbert

[57] ABSTRACT

A document receiving tray assembly (10) including a base (14) formed for positioning beneath a document handling machine and for support of the weight of the document handling machine thereon to hold the tray assembly (10) in place relative to the machine. A document catching tray (16) is pivotally attached to the base (14) by hinged members (20 and 22) and is formed for catching documents ejected from the associated machine. The document catching tray (16) pivots between an open, extended position for catching documents and a closed, retracted position substantially above the upper surface of the document handling machine for storing the tray (16) above the machine while the base (14) is held in place beneath the machine. A method for providing a storable document receiving tray assembly (10) includes the steps of selecting an appropriately-sized tray assembly (10) and placing the base (14) of the tray assembly (10) beneath the machine in weight bearing relationship to the base (14) to hold the tray assembly (10) in place relative to the machine.

15 Claims, 2 Drawing Sheets

DOCUMENT RECEIVING TRAY ASSEMBLY AND METHOD OF USING SUCH

FIELD OF THE INVENTION

This invention relates to a novel document receiving tray for use with document handling machines. More specifically, this invention relates to a document receiving tray particularly adapted for use with facsimile or telecopier machines.

BACKGROUND ART

Current document trays for catching documents ejected from facsimile machines are often removable from the machine for storage. An example of such a removable tray is shown connected to a photocopy machine in U.S. Pat. No. 4,814,825. Problems are encountered with these removable trays, however, such as breaking the tray by dropping it on the floor, accidentally misplacing the tray, and finding appropriate and convenient storage space for the tray.

Some document trays are designed to remain pivotally connected to an associated document handling machine at all times. During machine non-use, the document trays are pivoted to a storage position. When in this storage position, however, the trays often extend outwardly from the body of the machine and, thus, reduce the available workspace which can cause great inconvenience in limited-space environments. Typical of such document trays are the trays shown attached to photocopy machines in U.S. Pat Nos. 2,005,370 and 4,191,467.

In an effort to alleviate this storage problem, document trays were designed which fold upward to a storage position partially above the document handling machine. An example of such a tray is shown rotatably connected to a printer station in U.S. Pat. No. 5,061,098. A similar document tray configuration is illustrated in U.S. Pat. No. 5,082,269 in which the document tray may be pivoted to an upright, inoperative position adjacent the associated document handling machine. When in the stored position, however, these pivotable document trays prevent documents from being ejected from the machine, and operation of the machine will result in paper jamming.

To remedy the jamming problem, pivotable document trays have been designed which allow operation of the machine while the tray is in the stored position. For example, U.S. Pat. No. 3,912,389 discloses a copy medium receiving tray which includes a dual-tray construction in which one tray, a larger, rotatable tray, can pivot up into a storage position adjacent an associated copy machine, while a smaller tray remains in a fixed, stationary position extending away from the copy machine. This type of tray construction, however, does not solve the problem of limited space associated with fixed, stationary trays and cannot be retrofit to other telecopying machines.

An alternative embodiment disclosed in U.S. Pat. No. 3,912,389 involves a single, rotatable tray which includes an opening formed in the tray. When the tray is folded in a storage position, the opening is disposed in alignment with the document discharge opening of an associated machine. Although this alternative embodiment addresses both the problems of limited space and paper jamming, the tray is designed for use with a specific photocopy machine and includes specific structural means mounting the tray to the particular machine adjacent the document discharge opening of the machine. Thus, these document trays are not readily adaptable for use with various models of facsimile machines.

The difficulties suggested in the preceding are not intended to be exhaustive but rather are among many which tend to reduce the effectiveness and user satisfaction with prior document receiving trays. Other noteworthy problems may also exist; however, those presented above should be sufficient to demonstrate that such document receiving trays appearing in the past will admit to worthwhile improvement.

Accordingly, it is therefore a general object of the invention to provide a document receiving tray assembly which will obviate or minimize difficulties of the type previously described.

It is a specific object of the invention to provide a document receiving tray assembly which may be universally used with various facsimile machines as an add-on accessory.

It is another object of the invention to provide a document receiving tray assembly which is stored in an arrangement with an associated facsimile machine during machine non-use to maximize available workspace.

It is still another object of the invention to provide a document receiving tray assembly which allows ejection of documents from a facsimile machine while the tray is in a stored position.

It is a further object of the invention to provide a document receiving tray assembly which remains in proper alignment and in a stable assembled arrangement with an associated facsimile machine throughout its use.

It is yet a further object of the invention to provide a document receiving tray assembly which neatly collects fax documents flat and in a consecutive stacked arrangement and permits easy removal of the documents from the tray.

It is still a further object of the invention to provide a document receiving tray assembly which is easy and inexpensive to manufacture, durable, and easy to use.

It is yet another object of the invention to provide a method for providing a storable document receiving tray assembly for use with a facsimile machine.

DISCLOSURE OF INVENTION

A preferred embodiment of the invention which is intended to accomplish at least some of the foregoing objects includes a document receiving tray assembly having a base formed for positioning beneath a document handling machine. The base is positioned for support of the weight of the document handling machine thereon and holds the document tray in place relative to the document handling machine. A document catching tray is pivotally attached to the base by hinged members. The document catching tray catches documents ejected from a document discharge slot of the associated document handling machine.

The document catching tray pivots about the hinged members between an open, extended position for catching documents and a closed, retracted position. In the retracted position, the document catching tray is positioned substantially above the upper surface of the document handling machine for storing the tray above the machine while the base is held in place beneath the machine.

An method for providing a storable document receiving tray assembly for use with an associated document handling machine in accordance with a preferred embodiment of the invention includes the steps of selecting a document receiving tray assembly including a thin plate-like base and a document catching tray pivotally mounted thereto; and placing the base of the tray assembly beneath the machine in weight bearing relationship to the base to hold the tray assembly in place relative to the machine.

BRIEF DESCRIPTION OF THE DRAWING

Other objects and advantages of the present invention will become apparent from the following detailed description of a preferred embodiment thereof taken in conjunction with the accompanying drawings.

BEST MODE OF CARRYING OUT THE INVENTION

Figure 1:
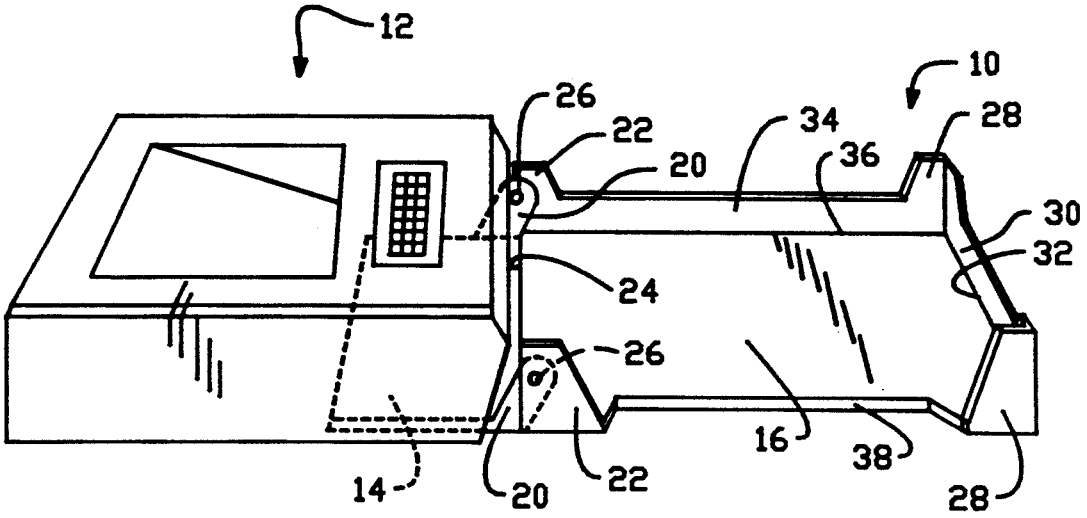
FIG. 1 is a top perspective view illustrating a document receiving tray assembly in accordance with a preferred embodiment of the invention and positioned beneath a facsimile machine.

Referring now to the drawings, wherein like numerals indicate like parts, and initially to FIG. 1, there will be seen a document receiving tray assembly, generally indicated 10, positioned beneath a facsimile machine 12. The document receiving tray assembly of the present invention is particularly adapted for use with telecopier or fax machines as an add-on accessory and will be described in association with a fax machine. However, it will be understood that the subject tray assembly may be used with any similarly sized document handling machine, such as a computer printer.

Tray assembly 10 is comprised of two major components, namely, a base 14 formed for positioning beneath an associated fax machine and a document catching tray 16 for catching documents ejected from the fax machine. The tray assembly of the present invention is preferably composed of lightweight plastic material and may be formed by injection molding. Tray 16 is pivotally attached to base 14 so that tray 16 may pivot between an open, extended position and a closed, retracted position, as will be described in more detail in connection with FIG. 2. In FIG. 1, tray 16 is shown in the open, extended position for receipt of documents ejected from a document discharge slot in fax machine 12.

To mount tray assembly 10 to fax machine 12, base 14 is positioned beneath fax machine 12 . In this manner, tray assembly 10 may be retrofit to various models of fax machines. Base 14 supports the weight of machine 12 thereon to hold tray assembly 10 in place relative to the machine. The weight of machine 12 bearing down on base 14 allows cantilevering of tray 16 outwardly from fax machine 12. Base 14 is generally a thin plate-like member and extends underneath fax machine 12 by an amount sufficient to be engaged by the bottom or a support leg (not shown) of fax machine 12. In a preferred embodiment, the length of base 14 is approximately equal to at least a third of the length of fax machine 12 to ensure stability of tray assembly 10.

In order to pivotally attach tray 16 to base 14, base 14 is provided with a pair of upwardly extending flanges 20. Similarly formed flanges 22 are provided on a first end 42 of tray 16 adjacent fax machine 12 and are hinged to flanges 20 by pin 26. In a preferred embodiment, the width of tray 16 is slightly larger than that of base 14, and tray 16 is pivotally attached to base 14 so that flanges 22 are mounted outside of flanges 20. Flanges 20 and 22 permit pivotal movement of tray 16 about pin 26 from an open, extended position to a closed, retracted position substantially above upper surface 18 of fax machine 12.

In a preferred embodiment, flanges 20 and 22 are of equal height and are hinged together at substantially the same point on the flanges so that, when tray 16 is in the open, extended position, base 14 and tray 16 are in substantially the same horizontal plane. The height of pivotal joints 26 relative to the plane defined by base 14 and tray 16 ensures that tray 16 and documents supported therein can be cantilevered effectively from base 14 without placing undue strain on the joints 26. In an alternative embodiment, flanges 20 and 22 may have different height dimensions. For example, if the document discharge slot is located near the upper surface of the machine, it may be desirable to position the tray near the top of the machine, closer to the discharge slot. This may be accomplished by lengthening the flanges on the base and reducing the height the flanges on the tray so that, in the open, extended position, the tray lies on a plane significantly higher than the plane of the base and, therefore, nearer the top of the machine.

In addition to flanges 22, tray also includes a pair of upwardly extending corner flanges 28 to prevent documents ejected from machine 12 from sliding off of tray 16. An upwardly extending side flange 30 formed along a second end 32 of tray 16, in combination with an upwardly extending side flange 34 formed along one side 36 of tray 16, facilitates stacking of documents in an orderly arrangement on tray 16, while permitting easy retrieval of documents from the other side 38 of tray 16.

Figure 2:
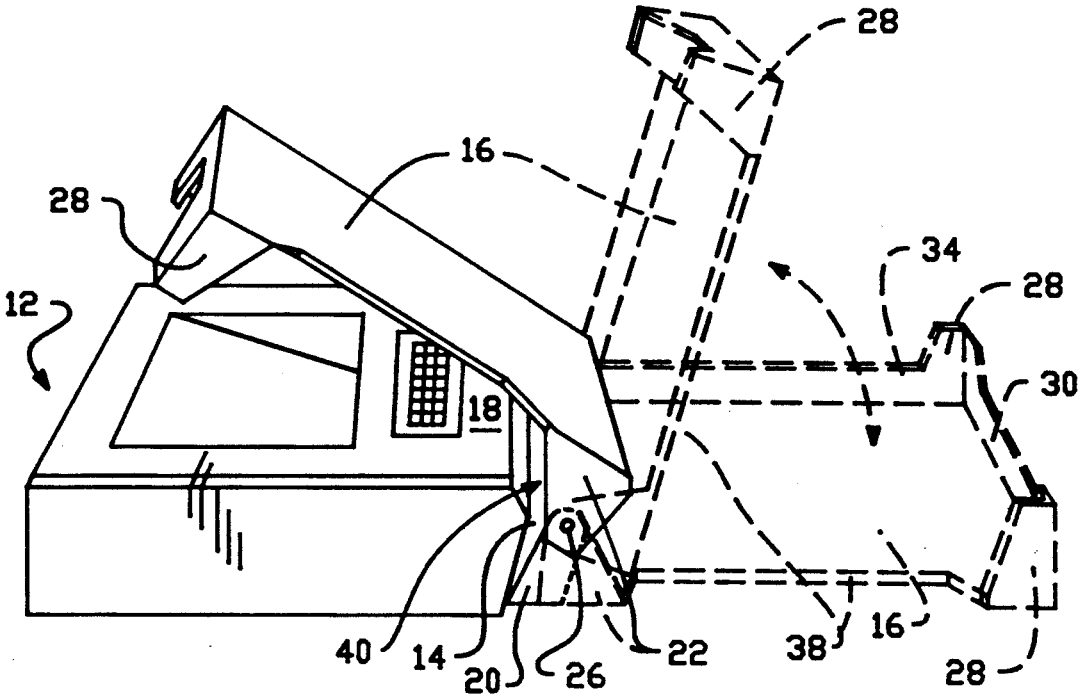
FIG. 2 is a top perspective view corresponding to FIG. 1 and illustrating pivotal movement of the tray assembly between an open, extended position and a closed, retracted position.

FIG. 2 illustrates the range of pivotal motion of tray 16 about pin 26 between an open, extended position, shown in phantom, and a closed, retracted position, shown by solid lines. In the open, extended position, tray 16 extends outward a substantial distance from machine 12. In this extended position, tray 16 occupies space adjacent machine 12. In limited workspace environments, it is advantageous to provide a tray assembly which may be pivoted into a storage position which creates more workspace. Tray 16 of the subject invention may be pivoted upward in the direction of the arrows to the closed, retracted position without dismantling the tray assembly from the fax machine. In this closed, retracted position, tray 16 is positioned substantially above upper surface 18 of machine 12 in a relatively compact arrangement with fax machine 12. Conventional document trays for fax machines may not be pivoted to such a storage position. When tray 16 is stored above machine 12, base 14 remains held in place beneath machine so that tray assembly 10 need not be removed from machine during machine non-use.

Tray assembly 10 is advantageously constructed so that flanges 20 and 22 have a combined height dimension sufficient with respect to the vertical height of machine 12 to permit tray 16 to pivot upward and over upper surface 18 of machine 12. Thus, although fax machines typically have a significant height dimension, flanges 20 and 22 of tray assembly 10 may be formed with a height dimension large enough to accommodate the bulky models of fax machines.

Figure 4:
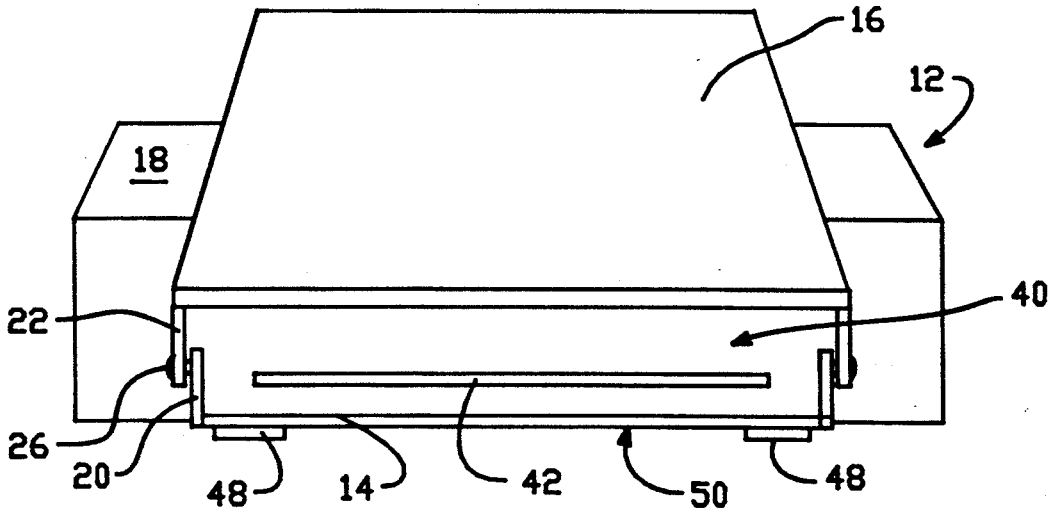
FIG. 4 is a top perspective view of the front end of the facsimile machine with the document receiving tray assembly of FIG. 1 mounted thereto and shows the tray assembly in a closed, retracted position.

When in the closed, retracted position, tray 16 and base 14 produce a rectangular opening 40 which is aligned with discharge slot 42 of fax machine 12, as shown in FIG. 4. Thus, even in the closed, retracted position, tray 16 does not cause jamming of the fax machine, but instead allows documents ejected from the machine to pass through opening 40 and fall to the floor or onto the support table on which the machine rests.

Figure 3:
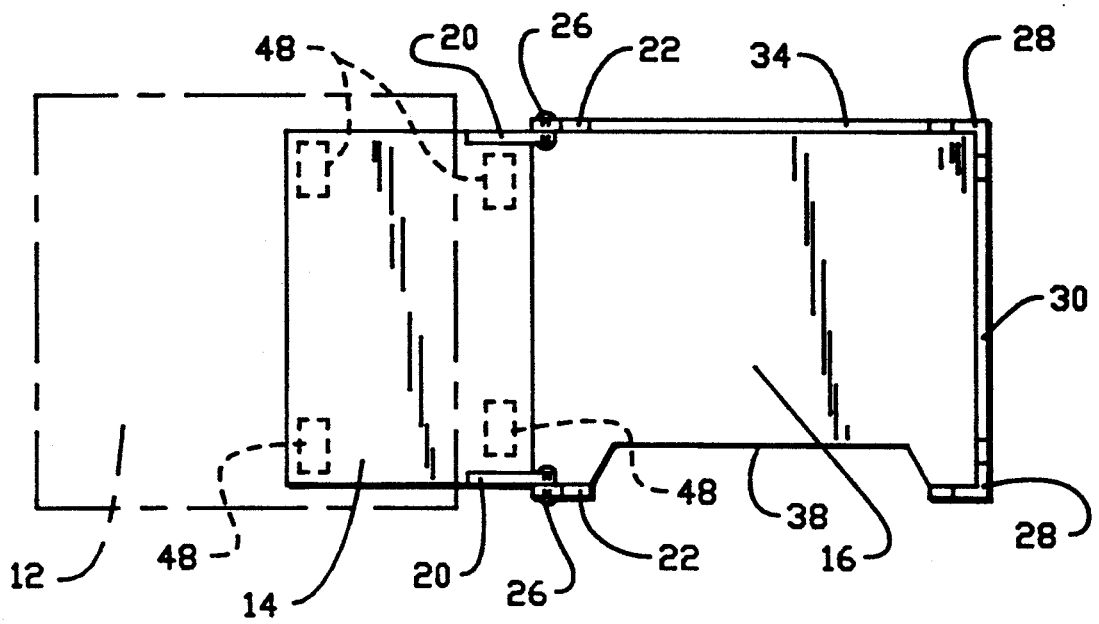
FIG. 3 is an enlarged, top plan view of the document receiving tray assembly of FIG. 1.

Turning to FIG. 3, it will be seen that base 14 extends inwardly from flanges 20 and 22 beneath machine 12 so that a portion of the weight of machine 12 bears down on base 14 to hold tray assembly 10 in place. Base 14 is also provided with at least one and, preferably, four non-slip patches or rubber footing members 48 mounted to the lower surface 50 of base 14. The combination of the weight of machine 12 and the positioning of patches 48 on base 14 prevents the tray assembly from shifting out of alignment with the machine and also prevents the machine and tray assembly from shifting with respect to the surface on which the machine rests. In addition, non-slip patches or rubber footing members may be mounted on an upper surface of base 14 to provide further frictional contact between base 14 and machine 12.

Without attempting to set forth all of the desirable features of the instant document receiving tray assembly, at least some of the major advantages include the unique combination of base 14 and tray 16, each having a pair of upwardly extending flanges 20 and 22, respectively, which are pivotally attached together to permit tray 16 to fold upward to a storage position during machine non-use to maximize workspace. Pivoting tray 16 to the closed, retracted position may be accomplished without dismantling tray assembly 10 from machine 12, thus, avoids loss or breakage of the tray which are problems encountered with conventional fax trays. In addition, machine 12 is fully operable when tray 16 is in the closed, retracted position, since pivoting tray 16 to the closed, retracted position creates an opening 40 between tray 16 and base 14 for documents to pass through undamaged. This also prevents jamming of the machine.

The subject invention is also adaptable for use with virtually any fax machine as an add-on accessory, with the height of the flanges and the length of base being modifiable to accommodate unusually bulky or set-back fax configurations. Moreover, tray assembly 10 is easily installed to a machine by simply sliding base 14 beneath the machine.

Once installed, tray assembly 10 remains in proper alignment and in a stable assembled arrangement with the associated fax machine throughout its use. The combination of the weight of the machine bearing down on base 14 and the frictional engagement of non-slip patches 48 with the support surface on which the machine and tray assembly rests produces a stable arrangement.

A method for providing a storable document receiving tray assembly for use with an associated facsimile machine in accordance with a preferred embodiment of the invention includes the steps of selecting an appropriately-sized tray assembly and placing the base of the tray assembly beneath the machine to position the machine in weight bearing relationship to the base. The weight of the machine holds the tray assembly in place relative to the machine. The selecting step is preferably accomplished by selecting a tray assembly with hinged flanges formed to pivot a document catching tray between an open, extended position for catching documents and a closed, retracted position for storage during machine non-use. In the open, extended position, the tray is positioned in alignment with a document discharge opening in the document handling machine. In the closed, retracted position, the document catching tray is positioned substantially above the fax machine.

In describing the invention, reference has been made to a preferred embodiment and illustrative advantages of the invention. Those skilled in the art, however, and familiar with the instant disclosure of the subject invention, will recognize additions, deletions, modifications, substitutions, and other changes which will fall within the purview of the subject invention and claims.

What is claimed is:

1. A document receiving tray assembly suitable for use as an add-on accessory to a document handling machine comprising:

a base formed for positioning beneath the document handling machine for support of a portion of the weight of the document handling machine thereon to hold said tray assembly in place relative to the document handling machine; and a document catching tray for catching documents ejected from a document discharge means of the document handling machine and being pivotally attached to said base by hinge means, said hinge means pivoting said tray between an open, extended position for catching documents ejected from the document handling machine and a closed, retracted position, said tray being positioned substantially above the upper surface of the document handling machine in said retracted position for storing of said tray above the document handling machine while said base is held in place beneath the document handling machine.

2. A document receiving tray assembly as defined in claim 1 wherein, said hinge means attaches said tray to said base for movement to said retracted position defining an opening aligned with the document discharge means of the document handling machine.

3. A document receiving tray assembly suitable for use as an add-on accessory to a document handling machine comprising:

a base formed for positioning beneath the document handling machine for support of a portion of the weight of the document handling machine thereon to hold said tray assembly in place relative to the document handling machine;

a document catching tray for catching documents ejected from a document discharge means of the document handling machine and being pivotally attached to said base by hinge means, said hinge means including a first set of upwardly extending flanges formed on one end of said base and a second set of upwardly extending flanges formed on a first end of said tray positioned adjacent the document handling machine and being pivotally connected to said first set of upwardly extending flanges for pivotal motion of said tray between an open, extended position proximate said base for catching documents ejected from the document handling machine and a closed, retracted position, said tray being positioned substantially above the upper surface of the document handling machine in said retracted position for storing of said tray above the document handling machine while said base is held in place beneath the document handling machine.

4. A document receiving tray assembly as defined in claim 3, wherein, said first set and said second set of upwardly extending flanges have a combined height dimension sufficient with respect to the document handling machine for pivoting said tray to said closed, retracted position substantially above the document handling machine.

5. A document receiving tray assembly as defined in claim 4 wherein, said first set and said second set of upwardly extending flanges are of equal height and are hinged together at substantially the same point on said flanges to position said tray in substantially the same plane as said base when said tray is in said extended position.

6. A document receiving tray assembly as defined in claim 5 wherein, said tray includes a pair of upwardly extending corner flanges formed on a second end of said tray for preventing documents from sliding off of said tray.

7. A document receiving tray assembly as defined in claim 6 wherein, said tray includes an upwardly extending side flange formed along said second end of said tray and an upwardly extending side flange formed along one side of said tray to facilitate stacking of document in an orderly arrangement on said tray, while permitting easy retrieval of documents from the other side of said tray.

8. A document receiving tray assembly as defined in claim 3, wherein, said document receiving tray assembly is composed of a plastic material.

9. A document receiving tray assembly as defined in claim 3, wherein, said tray is cantilever supported from said base by said hinge means.

10. A document receiving tray assembly as defined in claim 3, wherein, said base is provided as a thin substantially planar member extending inwardly from said hinge means by an amount sufficient to be engaged by a support member of the document handling machine.

11. A document receiving tray assembly as defined in claim 3, wherein, said base includes at least one non-slip patch mounted on a lower surface thereof.

12. A document receiving tray assembly as defined in claim 3, wherein, said base includes a plurality of rubber footing members mounted on one of an upper and lower surface thereof.

13. A document handling assembly comprising:

a document handling machine having a document discharge means; and an add-on document receiving tray assembly including (i) a base positioned beneath said document handling machine for support of a portion of the weight of said document handling machine thereon to hold said tray assembly in place relative to said document handling machine and (ii) a document catching tray for catching documents ejected through said document discharge means and being pivotally attached to said base by hinge means, said hinge means pivoting said tray between an open, extended position and a closed, retracted position, said tray being positioned substantially above the upper surface of said document handling machine in said retracted position for storing of said tray above said document handling machine while said base is held in place beneath said document handling machine.

14. A method for providing a storable document receiving tray assembly for use with an associated document handling machine:

selecting said document receiving tray assembly including a thin substantially planar base and a document catching tray pivotally mounted thereto;

placing said base of said document receiving tray assembly beneath the document handling machine and positioning the document handling machine in weight bearing relationship to said base to hold said tray assembly in place relative to the document handling machine; and pivoting said tray relative to said base and said handling machine between a selected one of an open, extended position, for receiving documents ejected from a document discharge opening in the document handling machine, and a closed, retracted position substantially above the document handling machine for storing said tray relative said handling machine.

15. A method for providing a storable document receiving tray assembly as defined in claim 14 wherein, said selecting step is accomplished by selecting a tray assembly with hinge means formed to pivot said tray between said open, extended position and said closed, retracted position.

* * * * *